US005228576A

United States Patent [19]

Axmann

[11] Patent Number: 5,228,576

[45] Date of Patent: Jul. 20, 1993

[54] DEVICE FOR SORTING SMALL ARTICLES

[75] Inventor: Norbert Axmann, Sinsheim-Hoffenheim, Fed. Rep. of Germany

[73] Assignee: Axmann-Fördertechnik GmbH, Sinsheim-Steinsfurt, Fed. Rep. of Germany

[21] Appl. No.: 732,640

[22] Filed: Jul. 19, 1991

[30] Foreign Application Priority Data

Aug. 16, 1990 [DE] Fed. Rep. of Germany ..... 4025926

[51] Int. Cl.[5] ..... B07B 13/04; B07C 5/02

[52] U.S. Cl. ..... 209/674; 209/393; 209/660

[58] Field of Search ..... 209/660, 674, 675, 676, 209/677, 678, 625, 621, 626, 682, 393, 396

[56] References Cited

U.S. PATENT DOCUMENTS

| | | | |
|---|---|---|---|
| 425,705 | 4/1890 | Smallwood | 209/674 |
| 2,321,742 | 6/1943 | Garcia | 209/660 |
| 3,042,200 | 7/1962 | Nowak | 209/674 |
| 3,645,396 | 2/1972 | Reiss | 209/674 |
| 3,971,716 | 7/1976 | Foreman | 209/596 |
| 4,003,831 | 1/1977 | Tishkor et al. | 209/674 X |

FOREIGN PATENT DOCUMENTS

| | | | |
|---|---|---|---|
| 87706 | 9/1921 | Fed. Rep. of Germany | 209/396 |
| 787423 | 12/1957 | United Kingdom | 209/676 |

*Primary Examiner*—Donald T. Hajec
*Attorney, Agent, or Firm*—Max Fogiel

[57] ABSTRACT

A device for sorting small articles by size. A chute conveys the articles. A gap allows articles of less than a prescribed size through it. The gap is between the chute and a mechanism that extends across the slide. The mechanism detaches and conveys larger articles away along the gap. The object is to prevent articles from becoming jammed upstream of the gap. The gap is a channel that extends essentially across the slope of the chute. The channel is demarcated by two baffles. One baffle merges into the chute. The other merges into the detaching and conveying mechanism. The mechanism also has means of intermittently lifting or tossing articles that become jammed upstream of the channel.

10 Claims, 4 Drawing Sheets 18
11(11')
12
30
38
35
43
15
32
22
42
26(26')
34
39
(39')
14
40
41
16
32
20(20')

18
11(11')
12
30
38
35
16
32
22
39(39')
26(26')
14
20(20')
37(37')
21(21')

DEVICE FOR SORTING SMALL ARTICLES

BACKGROUND OF THE INVENTION

The invention concerns a device for sorting small articles by size, with a chute for conveying the articles and with a gap that allows articles of less than a prescribed size through it between the chute and a mechanism that extends across the slide and detaches and conveys larger articles away along the gap.

Devices of this type are employed in particular to sort plastic articles leaving extruders. These articles include both finished pieces and waste. The invention accordingly especially concerns a device for separating the articles leaving an extruder into product and sprue.

In one known device of this genus, a belt or other appropriate conveyor delivers the articles being sorted to the top of a chute. They slide down between it and a conveyor screw positioned across the slope of the chute and at a distance from it. A motor rotates the screw in a direction opposite the slope. The worm is far enough from the chute to allow smaller articles through. The screw carries the larger articles off to one side.

Prerequisite to this method of sorting of course is that the parts that are to be separated differ at least to some extent in size. This prerequisite is practically always satisfied by extruded-plastic articles in that the products are almost always compact articles while the sprues are comparatively bulky.

One situation does affect the capacity to separate products from waste, however. Sometimes the former hook together and fail to drop through the gap between the chute and the screw, which carries them off to the side. This occurrence undesirably increases the rejection rate. One remedy comprises providing the screws with prongs that extend over the threads. The prongs intercept the hooked-together articles and lift them off the chute to release them.

The rate of separation attainable with screws of this type has not been satisfactory, and sorting devices with oscillating chutes have been tried. The system was intended to allow transverse conveyance along the length of a cylinder separated from the chute and to ensure separation due to the oscillation. This device did provide better separation and hence sorting than the aforesaid device. It was, however, still not absolutely satisfactory when the articles were complicated in shape. It has accordingly not yet been possible to satisfy all practical requirements as to the separation of product from waste.

SUMMARY OF THE INVENTION

The object of the present invention is accordingly a device of the aforesaid genus and purpose that will separate and sort better than devices at the state of the art.

This object is attained in accordance with the invention in that the gap is a channel that extends essentially across the slope of the chute and is demarcated by two baffles, one of which merges into the chute and the other into the detaching and conveying mechanism, and in that said mechanism has means of intermittently lifting or tossing articles that become jammed upstream of the channel.

Thus, the known gap is replaced in accordance with the invention by a definite channel. Articles with at least one dimension shorter than channel is wide will drop through it. The detaching and conveying mechanism will intermittently toss the larger articles, sprues for example, but articles that have hooked together too. The tossed articles will drop back onto the chute and toward the channel. Smaller articles will accordingly be separated from larger articles. The former will separate from the latter and drop through the channel and the larger ones will gradually be conveyed away along the channel.

A particular advantage is ensured when the chute slopes not only toward the channel but also along the channel and when the angle of inclination to the horizontal can be adjusted. This feature allows adaptation to particular types of article and, in particular, acceleration and deceleration of the lateral removal of the larger articles.

Many means of lifting and tossing articles that jam up upstream of the channel can be employed. It turns out, however, to be especially practical when the mechanism that detaches and conveys articles away along the channel includes means of lifting and tossing such articles in the form of an oscillating surface that intermittently travels up and down. An oscillating surface of this type will, as it travels up and down, toss up any larger or hooked-together articles. The articles will release as they fall, and the small ones will drop through the channel, leaving any bulky ones, sprue for example, to be carried off to the side.

An especially effective separation of hooked-together articles can be attained in such a device if, as the oscillating surface travels up and down, at least some areas arrive above and below an edge located between the chute and the adjacent channel. The amplitude of excess should be considerable. Characteristic of this advanced version of the invention accordingly is that the oscillating surface travels far. It will therefore be of advantage for the amplitude of the oscillating surface's up-and-down travel to be variable.

The oscillating surface in another important embodiment of the invention diverges from the chute and, as seen in cross-section, constitutes in conjunction with the chute a hopper that tapers toward the channel. The hopper will force any articles that arrive on the chute for sorting into the channel. Articles sliding down along the slope of the chute will consequently impact the oscillating surface at an angle, and its intermittent up-and-down motion will toss them up and back onto the chute. The procedure will recur while any articles that do not pass through the channel are being conveyed all the way across. The result will be extremely effective release of hooked-together articles and hence practically complete separation of articles by size.

Depending on the type of articles being separated, it may be practical for not only the amplitude but also the frequency at which the oscillating surface travels to be variable.

The oscillating surface can be driven pneumatically by at least one cylinder. The cylinder will engage the oscillating surface and be intermittently pressurized at a prescribed frequency.

The oscillating surface can, however, also be driven by an electric motor. The motor's rotation can be converted into linear motions by a take-off crank if the end of the crankshaft that is remote from the crank is articulated to the oscillating surface. This system has been proven practical in that it allows the frequency of the oscillating surface to be controlled very simply with a variable-speed motor.

Also of interest in terms of adaptability to various conditions is an advanced version wherein the width of the channel that constitutes the gap is variable. This feature can be facilitated if the chute and the adjacent baffle that demarcates the channel are continuously variable. The variability can be embodied in a spindle that allows fine adjustment for example.

In summary, the present invention provides an arrangement for sorting small articles by size, in which a chute slide receives and conveys the articles. A channel with a gap communicates with the chute slide, and smaller articles of less than a predetermined size pass through the gap substantially along a dropping line. An oscillating plate extends across the chute slide for the purpose of separating and conveying away larger articles along the gap. This channel is substantially transverse to the dropping line and borders the oscillating plate, while the channel is also bordered by the chute slide. The oscillating plate is vertically moveable and is intermittently raised with the articles lying along the channel. The oscillating plate transverses up and down, during the intermittent raising motion. An edge is located between the chute slide and the channel, and communicates with the chute slide for separating and conveying the larger articles away from the channel, and thereby sort the smaller articles from the larger articles.

BRIEF DESCRIPTION OF THE DRAWINGS

One embodiment of the invention will now be specified by way of example with reference to the accompanying schematic drawing, wherein.

DESCRIPTION OF THE PREFERRED EMBODIMENTS

Figure 1:
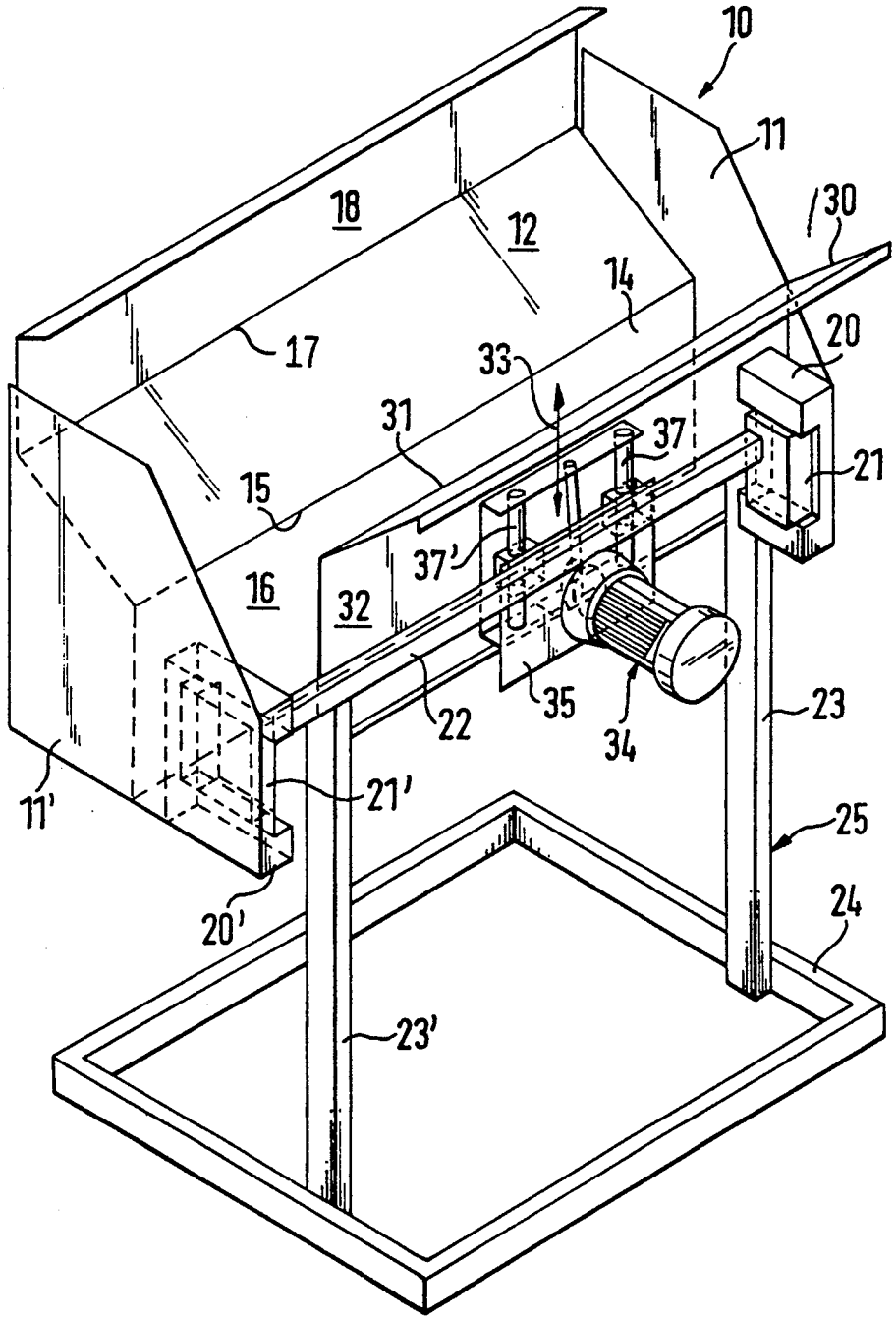
FIG. 1 is an overall perspective view of a device for separating small articles by size mounted on a supporting structure.

A device 10 for sorting small articles by size includes a chute 12. The chute is accommodated between two sheets 11 and 11' of metal. It slopes down to an elongated channel 14. The width of the channel is variable. Along the lower edge 15 of chute 12 is a baffle 16. This baffle demarcates one side of channel 14. Along the other edge 17 of the chute is another, upright, baffle 18 that demarcates the outside of the intake area. Chute 12, the baffle 16 that demarcates one side of channel 14, and the upright baffle 18 at the intake end, are all secured stationary between sheets 11 and 11'. Horizontal guides 20 and 20' are secured to the end of sheets 11 and 11' remote from upright baffle 18. Slides 21 and 21' travel back and forth in the guides and can be secured at any point therein. The slides are secured to the ends of a beam 22. The beam is secured at each end to lateral posts 23 and 23'. The posts are secured upright to the base 24 of a supporting structure 25.

Figure 3:
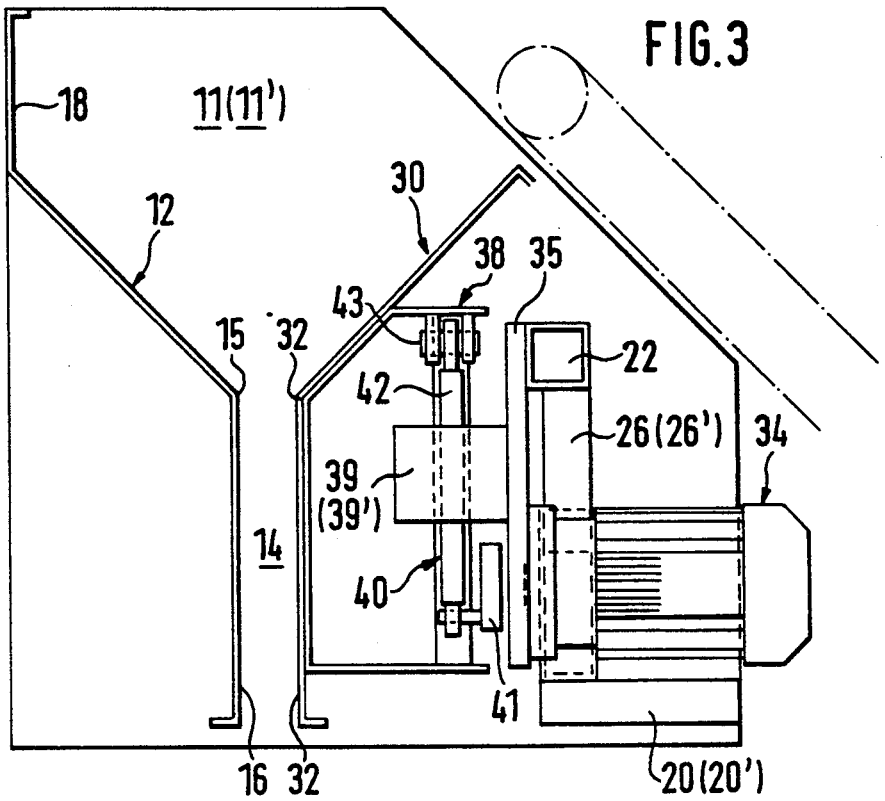
FIG. 3 is a section along the line III—III in FIG. 2 with a conveyor depicted in dot-and-dash lines that delivers the articles for sorting.
Figure 4:
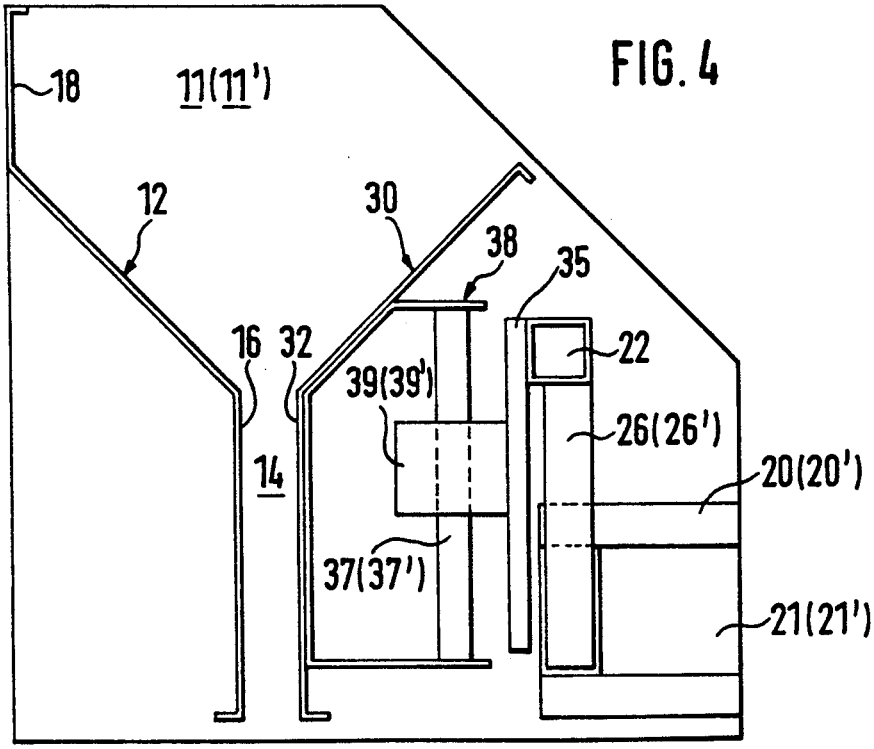
FIG. 4 is a section along the line IV—IV in FIG. 2.
Figure 5:
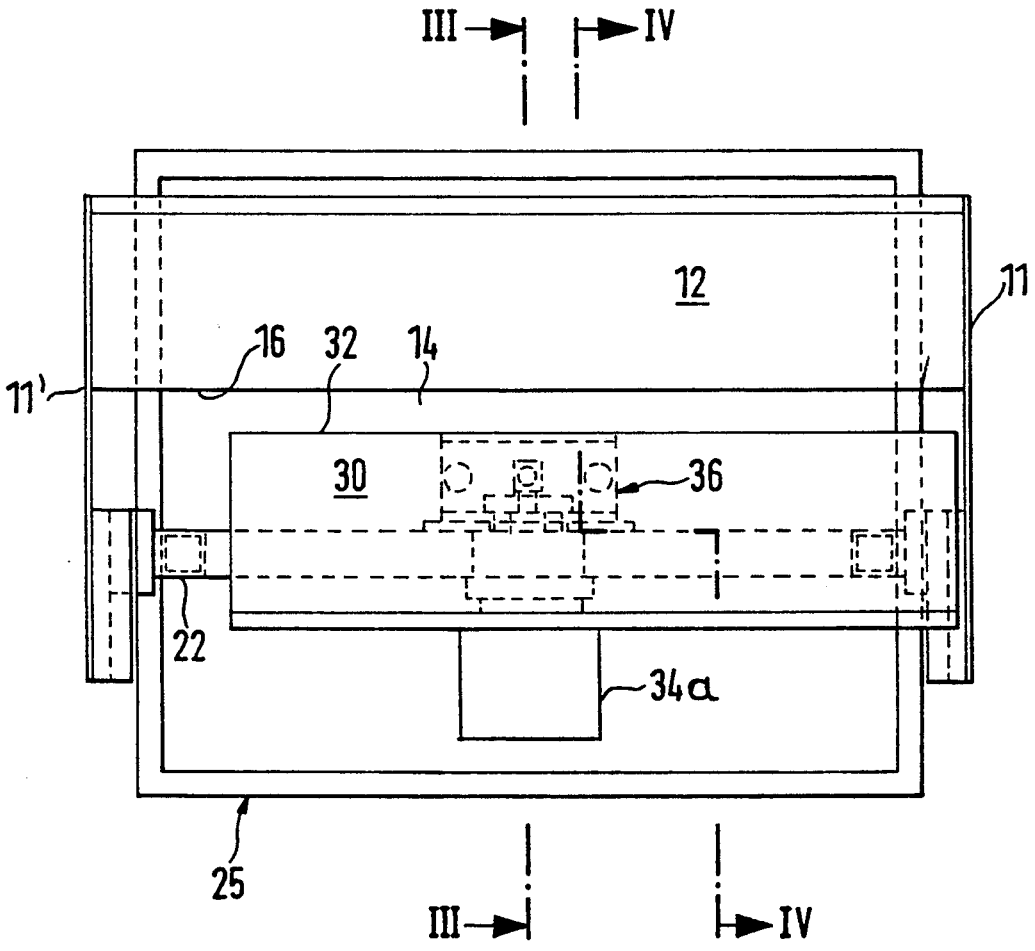
FIG. 5 is a top view of another embodiment of FIG. 2.

As will be evident from FIGS. 3 and 4, the ends of beam 22 are, in contrast to what is suggested by the highly simplified FIG. 1, not attached directly to the slides 21 and 21' in guides 20 and 20's but by way of vertical intermediates 26 and 26'. The intermediates are rigidly secured to both beam 22 and slides 21 and 21'.

In addition to chute 12, the device has an oscillating surface 30. Surface 30 moves up and down. Merging into one edge 31 of channel 14 is another baffle 32. This baffle demarcates the side of the channel that faces oscillating surface 30. Oscillating surface 30 moves up and down in conjunction with the associated baffle 32 that demarcates one side of channel 14. The up-and-down motion is indicated by the double-headed arrow 33 in FIG. 1. The rate of this motion is prescribed and is governed by an electric motor 34. The motor is mounted on a base 35 that is rigidly secured to beam 22. The oscillating surface's vertical track 36 comprises two columns 37 and 37', a bracket 38, and sections 39 and 39'. The bracket is rigidly secured to oscillating surface 30. Each section is mounted on a column. The side of each section that faces the oscillating surface is rigidly secured to base 35 on each side of electric motor 34.

The up-and-down motion of oscillating surface 30 is derived from the rotation of the motor. The rotation is converted into a linear motion by a thrust mechanism 40. Its crank 41 is mounted on the motor's driveshaft, which extends through base 35. The end of its thrust rod 42 remote from the shaft pivots in the bracket 38 on oscillating surface 30. It is practical to employ a variable-speed motor. Such a motor facilitates adjusting the rate of up-and-down motion to various operating conditions. The functions of the motor can be carried out also by a pneumatic device 34*a*.

One position of oscillating surface 30 is illustrated in FIGS. 3 and 4. The longitudinal edge 15 of chute 12 is at the same level as the longitudinal edge 31 of the oscillating surface. The baffle 16 that extends out of edge 15 is also at the same level as the baffle 32 that extends out of edge 31. As electric motor 34 raises and lowers oscillating surface 30 by way of thrust mechanism 40 in the direction indicated by the double-headed arrow in FIG. 1, however, the relative positions will be different. The lower longitudinal edge 31 of oscillating surface 30 will travel back and forth beyond the corresponding longitudinal edge 15 of chute 12. In contrast to the amplitudes encountered in vibrating conveyors, the distances traveled by the oscillating surface 30 in the present invention are relatively long.

Figure 2:
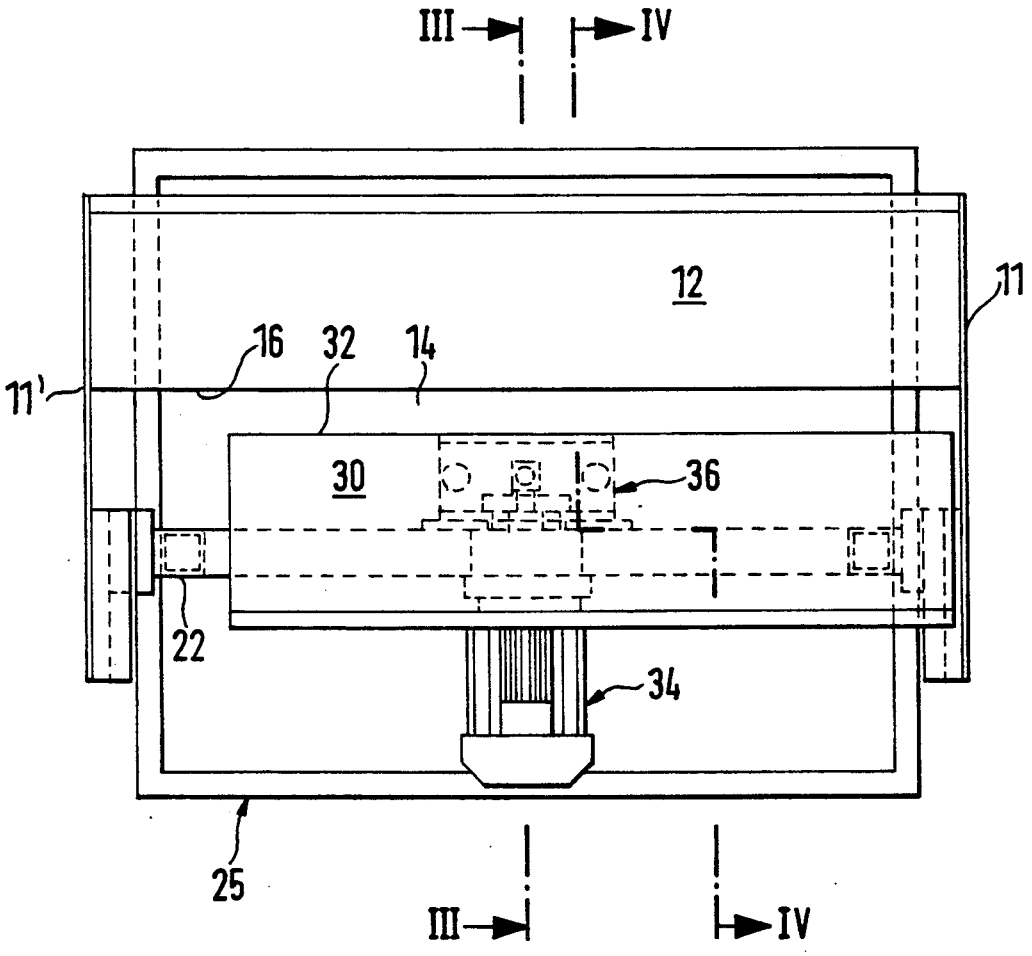
FIG. 2 is a top view of the device illustrated in FIG. 1.

As will be evident from FIGS. 1 and 2, chute 12 and its adjacent baffle 16, which demarcates one side of channel 14, extend from one metal sheet 11 to second metal sheet 11'. Oscillating surface 30 and baffle 32, which demarcates the other side of channel 14, extend on the other hand at one end as far as sheet 11 but terminate at a definite interval from sheet 11'. The initial section of the canal is defined by the lower longitudinal edges 15 and 31 of chute 12 on the one hand and by oscillating surface 30. This section slopes at a prescribed and variable angle towards the side of the device where oscillating surface 30 terminates at a definite interval from sheet 11'.

Small articles that arrive on chute 12 when the device is in operation are constantly lifted by the intermittent up-and-down motions of oscillating surface 30 at a right angle to the length of the channel, and fall back. The slope of channel 14 gradually and continuously conveys the articles that do not drop through the channel to the end of the oscillating surface. At this point the articles that have not dropped through the channel can now drop unimpeded into a container. The small articles, which drop through the channel, arrive in another container. To improve adaptability to various conditions, the angle at which the initial section of the channel is defined by lower edges 15 and 31, chute 12, and oscillating surface 30, can be varied.

The width of channel 14 can also be varied to improve the adaptability of the device to various conditions. The width is varied by displacing chute 12 and the baffle 16 that demarcates one side of channel 14 perpendicular to the length of the channel by means of the slides 21 and 21' accommodated in guides 20 and 20'. The slides can of course be secured in any position.

I claim:

1. An arrangement for sorting small articles by size, comprising: a chute slide for receiving and conveying said articles; a channel with a gap communicating with said chute slide, smaller articles of less than a predetermined size passing through said gap substantially along a dropping line; an oscillating plate extending across from said chute slide for separating and conveying away larger articles exceeding said predetermined size along said gap; said channel being substantially transverse to said dropping line and bordering said oscillating plate, said channel being bordered also by said chute slide, said oscillating plate being vertically movable; means for intermittently raising said oscillating plate and articles lying along said channel; said oscillating plate transversing up and down, during said intermittent raising, an edge between said chute slide and said channel communicating with said chute slide for separating and conveying said larger articles along said channel and thereby sort said smaller articles from said larger articles.

2. An arrangement for sorting small articles as defined in claim 1, wherein said chute slide slopes toward said channel as well as along said channel at an adjustable angle of inclination with respect to the horizontal.

3. An arrangement for sorting small articles by size, as defined in claim 1, wherein said oscillating plate traverses up and down with a variable amplitude of oscillating motion by said means for intermittently raising and tossing up said oscillating plate.

4. An arrangement for sorting small articles by size as defined in claim 1, wherein said oscillating plate diverges from said chute slide, said oscillating plate forming with said chute slide a hopper tapering toward said channel.

5. An arrangement for sorting small articles by size as defined in claim 1, wherein said oscillating plate traverses up and down with a variable frequency of oscillating motion by said means for intermittently raising and tossing up said oscillating plate.

6. An arrangement for sorting small articles by size as defined in claim 1, wherein said means for raising and tossing up said oscillating plate comprises: pneumatic means with at least one cylinder engaging said oscillating plate and pressurized intermittently at a predetermined frequency.

7. An arrangement for sorting small articles by size as defined in claim 1, wherein said means for raising and tossing up said oscillating plate comprises: an electric motor with output rotational motion; converter means connected to said motor for converting said rotational motion into linear motion; said converter means having a crank and reciprocating rod with an end hinged to said oscillating plate and another end connected to said crank.

8. An arrangement for sorting small articles by size, comprising: a chute slide for receiving and conveying said articles; a channel with a gap communicating with said chute slide, smaller articles of less than a predetermined size passing through said gap substantially along a dropping line; an oscillating plate extending across from said chute slide for separating and conveying away larger articles exceeding said predetermined size along said gap; said channel being substantially transverse to said dropping line and bordering said oscillating plate, said channel being bordered also by said chute slide, said oscillating plate being vertically movable; means for intermittently raising said oscillating plate and articles lying along said channel; said oscillating plate transversing up and down, during said intermittent raising, an edge between said chute slide and said channel communicating with said chute slide for separating and conveying said larger articles along said channel and thereby sort said smaller articles from said larger articles; said channel having a width; and means for varying the width of said channel.

9. An arrangement for sorting small articles by size as defined in claim 8, including a baffle adjacent said chute slide and demarcating said channel with said chute slide, said channel having a length and width, said chute slide and said baffle being variable at right angle to the length of said channel for varying the width of said channel.

10. An arrangement for sorting small articles by size, comprising: a chute slide for receiving and conveying said articles; a channel with a gap communicating with said chute slide, smaller articles of less than a predetermined size passing through said gap substantially along a dropping line; an oscillating plate extending across from said chute slide for separating and conveying away larger articles exceeding said predetermined size along said gap; said channel being substantially transverse to said dropping line and bordering said oscillating plate, said channel being bordered also by said chute slide, said oscillating plate being vertically movable, means for intermittently raising said oscillating plate and articles lying along said channel; said oscillating plate transversing up and down, during said intermittent raising, an edge between said chute slide and said channel communicating with said chute slide for separating and conveying said larger articles along said channel and thereby sort said smaller articles from said larger articles; said chute slide sloping toward said channel as well as along said channel at an adjustable angle of inclination with respect to the horizontal; said oscillating plate traversing up and down with a variable amplitude of oscillating motion by said means for intermittently raising and tossing up said oscillating plate; said oscillating plate diverging from said chute slide, said oscillating plate forming with said chute slide a hopper tapering toward said channel; said oscillating plate traversing up and down with a variable frequency of oscillating motion by said means for intermittently raising and tossing up said oscillating plate; said means for raising said oscillating plate comprising pneumatic means with at least one cylinder engaging said oscillating plate and pressurized intermittently at a predetermined frequency; said channel having a width, and means for varying said width of said channel; a baffle adjacent said chute slide and demarcating said channel with said chute slide, said channel having a length, said chute slide and said baffle being variable at right angle to the length of said channel for varying the width of said channel.

* * * * *